United States Patent [19]

Levy

[11] Patent Number: 4,819,804

[45] Date of Patent: Apr. 11, 1989

[54] SLIDE HOLDER

[76] Inventor: Abner Levy, 325 N. Oakhurst Dr., P4, Beverly Hills, Calif. 90210

[21] Appl. No.: 170,812

[22] Filed: Mar. 21, 1988

[51] Int. Cl.[4] ..... B65D 85/48

[52] U.S. Cl. ..... 206/456

[58] Field of Search ..... 206/456, 455

[56] References Cited

U.S. PATENT DOCUMENTS

| | | | |
|---|---|---|---|
| 2,262,058 | 11/1941 | Sinclair | 206/456 X |
| 2,761,557 | 9/1956 | McLean, Jr. | 206/456 |
| 2,761,558 | 9/1956 | McLean, Jr. | 206/456 |
| 2,804,202 | 8/1957 | Davis | 206/456 |
| 4,230,757 | 10/1980 | Toner | 206/456 X |
| 4,440,301 | 4/1984 | Intengan | 206/456 |

*Primary Examiner*—William Price

*Attorney, Agent, or Firm*—Beehler, Pavitt, Siegemund, Jagger & Martella

[57] ABSTRACT

A package for transporting a glass slide which carries a specimen for laboratory analysis makes use of a particularly light-weight yieldable material of the nature of Styrofoam. A thin base sheet of the material is provided with a rectangular recess slightly smaller than the glass slide and into which the slide may be pressed. Three edges of the base are each provided with a ridge leaving a fourth edge clear and a thin cover sheet of the same Styrofoam material fits snugly within the ridges where it is yieldably held in position covering the glass slide.

8 Claims, 1 Drawing Sheet

10
11
12
13
14
15
16
17
18
19
20
21
22
23
24
25
30
31
32
33
34
35
36
37
38
40
41
42
44
45
45'
46
47
48
3
4

SLIDE HOLDER

The handling of slide specimens for laboratory microscopic analysis has long been a practice in a vast variety of fields. In addition to medical and biological fields, the practice is useful in all manner of chemical and related analytical and experimental problems. A specimen smeared on a glass slide must carry accurate identification, must be kept sterile and free from contamination such as would impair the accuracy of the examination and must be capable of being dependably handled, stored and transported until the analysis is ready for completion.

The need for collection, packaging and storage alone has heretofore prompted the design and fabrication of small, inexpensive, disposable packets of various kinds of holders and made from various materials. In the interest of cost and disposability, cardboard and paper holders have been used, but with a significant lack of uniform acceptability and suitability as to all of the various fields of use.

It is therefore among the objects of the invention to provide a new and improved specimen slide holder which preserves the slide in a secure manner not only during storage and transportation but also on virtually all occasions when the slide needs to be handled.

Another object of the invention is to provide a new and improved specimen slide holder which is expressly easy and convenient to package, transport and store until ready for use.

Another object of the invention is to provide a new and improved specimen slide holder which is of virtually negligible weight and inexpensive to the point where it can be disposed of at will and at negligible cost.

Still another object of the invention is to provide a new and improved specimen slide holder of moldable yieldable material wherein the character of the material itself can be relied upon to hold the slide in place in all positions of handling including that when inadvertently turned upside down in the course of careless or inadvertent manipulation.

Further still among the objects of the invention is to provide a new and improved specimen slide holder wherein the character and design of the material itself can be used to, in effect, both lock the slide in place in the holder and also lock a cover in place over the slide in a secure protecting fashion.

Included also among the objects of the invention is to provide a new and improved specimen slide holder of moldable yieldable material productive of a self-locking feature for both the slide and its cover, which is virtually non-absorbent of fluid materials and wherein the holder and its cover can be molded initially as a single unit, readily broken apart when needed for use, and which can be so formed as to simultaneously accommodate a multiple number of specimen slides.

With these and other objects in view, the invention consists of the construction, arrangements, and combination of the various parts of the device serving as an example only of one or more embodiments of the invention, whereby the objects contemplated are attained, as hereinafter disclosed in the specification and drawings and pointed out in the appended claims.

Figures 1, 2, 3, 4, 5:
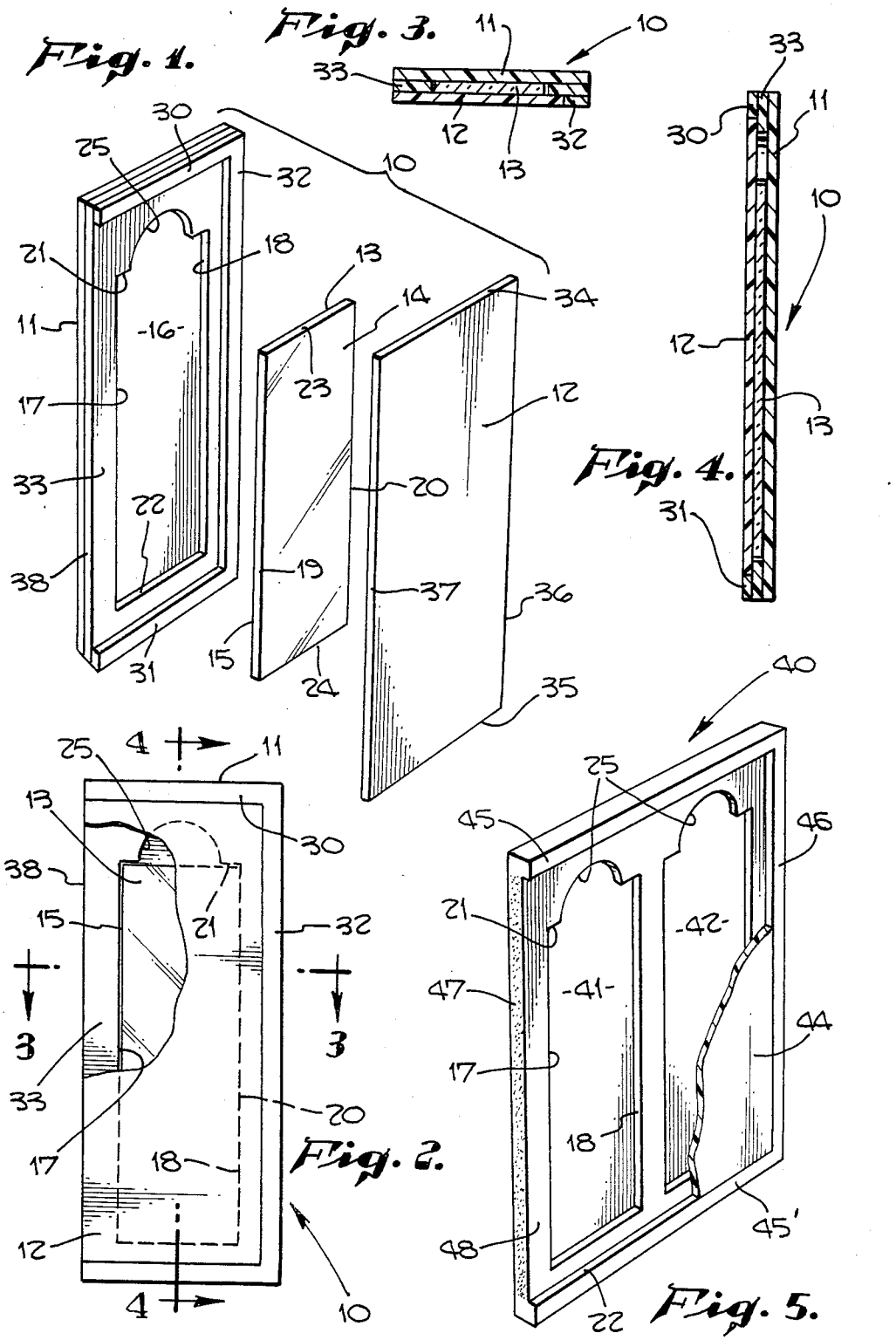
FIG. 1 is a front perspective exploded view of a single unit form of the invention.
FIG. 2 is a plan view partially broken away showing the single unit form loaded and ready for transportation.
FIG. 3 is a cross-sectional view on the line 3—3 of FIG. 2.
FIG. 4 is a vertical sectional view on the line 4—4 of FIG. 2.

FIG. 5 as a front perspective view of a multiple unit form of the device partially broken away.

In a single unit form of the invention, as shown in FIGS. 1 through 4, inclusive, there is shown a slide holder, indicated generally by the reference character 10, consisting of a base sheet 11 with its cover sheet 12 adapted to accommodate a substantially conventional specimen slide 13. Conventional specimen slides are customarily of glass and rectangular in shape so as to be readily handled when, for example, they are to be used for microscopic examination of a specimen smeared on a front face 14 of the slide. On some occasions identification media (not shown) may be etched upon either the front face 14 or rear face 15 of the slide for use in identification of the specimen on the slide or the manner in which it may have been procured.

Centrally disposed in the base sheet is a recess 16 of the same general outline as the outline of the slide 13. In order to hold the slide securely in position in the recess, opposite side walls 17 and 18 of the recess are spaced apart a distance no greater than the distance between side edges 19 and 20 of the slide 13. For added security, respective upper and lower walls 21, 22 may also be spaced apart a distance no greater than the distance between respective upper and lower edges 23, 24 of the slide 13.

Further still, the material selected as the material of the base sheet 11 may be of a moldable, yieldable substance such, for example, as a polyurethane, conventional Styrofoam or another of the synthetic plastic light-weight resin materials which, when formulated for molding, are adapted to be provided with air pockets, creating a finished material of yieldable resilient consistency. Under such circumstances it may be preferable to have the distance between side walls 17 and 18 in actuality something less than the distance between the side edges 19 and 20 of the slide so that when the slide is pressed into the recess, the side walls will be expanded to a slight degree as the slide is pressed into position, thereafter to exert lateral pressure on the side edges of the slide as an additional means of securing the slide snugly in the recess. This circumstance may also be provided with respect to the relationship between the distance between upper and lower walls 21, 22 of the recess and upper and lower edges 23, 24 of the slide.

For assistance in removing the slide 13 after it has been pressed into stored position within the recess 16, there is provided adjacent the upper wall 21 of the recess a finger depression 25, extending outwardly away from the upper wall 21. In addition to serving as a finger depression, the adjacent surface at the bottom of the finger recess 25 may serve to accept an identification means for whatever the specimen may be which is carried by the slide.

To accommodate the cover sheet 12 and hold it properly in place in a position protecting the slide 13, there is a retention ridge extending around the perimeter of the base sheet 11. In the chosen embodiment the retention ridge is formed of respective upper and lower ridge sections 30, 31 and a lateral ridge section 32, the three ridge sections thus defined together extending throughout a distance greater than one-half of the perimeter of the base sheet. The ridge sections 30, 31, 32 as defined in effect establish a frame for a receptive area 33 surrounding the recess 16.

Of further consequence is that the distance between respective upper and lower ridge sections 30, 31 be no greater than the distance between respective upper and lower edges 34, 35 of the cover sheet 12 so that the cover sheet will be snugly held in position covering the recess 16 when applied. Here, also, snug reception and retention of the cover sheet may be accomplished by reason of the composition of the cover sheet or material of the ridge sections or both. By use of compressible yieldable material of the type described for the base sheet, the distance between upper and lower ridge sections 30, 31 may be slightly less than the distance between respective upper and lower edges 34, 35 so that the cover sheet, when pressured into position between the upper and lower ridge sections, will be held in position either by inward pressure of the material of the ridge sections or outwardly acting pressure of the material of the cover sheet itself, or both.

Although as shown in FIG. 1 the base sheet 11 and cover sheet 12 are separate pieces, it may be preferable to form the cover sheet 12 initially as an extension of the base sheet 11 and by having the thickness of the cover sheet substantially the same as the depth of the ridge sections 30, 31, 32. The material of the base sheet and cover sheet is additionally one of a substantially frangible character so that when initially formed as a single sheet, the sheets may be broken apart at their adjacent edges when the cover sheet is to be applied over the slide. A score line between the adjacent edges may also be employed to faciliate accurate breakage at precisely the location of the adjacent edges.

To additionally facilitate neat and secure retention of the cover sheet within the ridge sections, it is preferable to have the distance between opposite side edges 36, 37 of the cover sheet 12 equal to the distance between the inside edge of the ridge section 32 and an opposite side edge 38 of the base sheet so that there will be no protruding part of the cover sheet when it is in closed position over the specimen slide 13.

Construction of the base sheet may be achieved in different ways. One way, as depicted, is to cut sections from a single sheet of uniform thickness so that the sections can be laminated together with the ridge sections comprising one laminate, the receptive area 33 comprising another laminate, and a third laminate of the same thickness residing beneath the receptive area 33 and providing a bottom for the recess 16. On this occasion the cover sheet 13 may be molded with the last mentioned bottom sheet or, in the alternative, the receptive area 33. As an alternative method all of the parts defined as laminates, together with the cover sheet, may be molded as a single piece with provision for breaking the cover sheet along the side edge 36 adjoining the side edge 38 of the base sheet. When the last defined method of forming is used, the molded thickness of the cover sheet can be made the same as the depth of the ridge sections or, in the alternative, by making certain that the height of the ridge sections is substantially that of the thickness of the cover sheet.

Although for accommodation of a single specimen slide 13 the holder may be as described in the form of invention of FIGS. 1 through 4, inclusive, the invention in another form may accommodate multiple slides, as exemplified by the dual slide holder 40 of FIG. 5 wherein there are two recesses 41, 42 within a receptive area 48. In the form of invention of FIG. 5, the recesses are made to bear the same relationship with respect to two separate specimen slides 13 of the type already made reference to in order to snugly and securely hold the slides in the base sheet when loaded. On this occasion there is a single cover sheet 44 covering both recesses adapted to be contained between respective upper and lower ridge sections 45, 45', as above described, the upper and lower ridge sections 45, 45' being joined at one edge by a lateral ridge section 46. The fit between ridge sections and perimetrical edges of the cover follows the same concept as has been disclosed in particular with respect to the first described form of the invention. Here also the thickness of the cover sheet 44 is the same as the depth of the ridge sections and as the thickness of the base sheet. Built in this fashion the base sheet and cover sheet may be molded as one sheet, capable of being broken apart at the location of an edge 47.

While a particular embodiment of the present invention has been shown and described, it will be obvious to those skilled in the art that changes and modifications may be made without departing from the invention in its broader aspects and, therefore, the aims of its appended claims are to cover all such changes and modifications as fall within the true spirit and scope of this invention.

Having described the invention, what is claimed as new in support of Letters Patent is as follows:

1. A holder for a specimen slide of substantially rectangular shape, said holder comprising a base sheet of lightweight yieldable moldable material of the same general configuration as said slide, a recess in the upper face of the base sheet of substantially the same configuration as said slide and spaced inwardly of peripheral edges of the base sheet forming a frame around said recess, said recess having a size no greater than the size of the slide and providing thereby retention means for holding the slide in the recess, a cover sheet of lightweight formable material and of substantially the same configuration as said base sheet, a retention ridge at the edge of said base sheet and extending for a distance around the perimeter defining a receptive area, said cover sheet having a size no smaller than said receptive area whereby the cover sheet is adapted to be held by the ridge in closed position over the recess.

2. A holder for a specimen slide as in claim 1 wherein the cover sheet and the base sheet are initially attached to each other at adjacent edges and the adjacent edges are clear of a retention ridge portion.

3. A holder for a specimen slide as in claim 2 wherein the base sheet, the ridge and the cover sheet are molded as a single piece and the attachment of said edges to each other is a frangible attachment.

4. A holder for a specimen slide as in claim 1 wherein the thickness of the specimen sheet is the same as the depth of said recess.

5. A holder for a specimen slide as in claim 1 wherein there is a finger depression in the frame of said base sheet adjacent the recess whereby to provide access to said slide.

6. A holder for a specimen slide as in claim 1 wherein there is a depression in the frame adjacent to and adjoining one side edge of the recess and having the same depth as said recess whereby to accommodate identification means for material on said slide.

7. A holder for a specimen slide as in claim 1 wherein there is a plurality of recesses in spaced parallel relationship within said frame and said cover sheet has a size extending over all said recesses.

8. A holder for a specimen slide as in claim 7 wherein the cover sheet and the base sheet are attached to each other with a frangible attachment adjacent the edge of one only of said recesses.

* * * * *